US012390054B1

(12) United States Patent
Chen

(10) Patent No.: US 12,390,054 B1
(45) Date of Patent: Aug. 19, 2025

(54) FOLDABLE BATH FRAME

(71) Applicant: Xiao Chen, Zhejiang (CN)

(72) Inventor: Xiao Chen, Zhejiang (CN)

( * ) Notice: Subject to any disclaimer, the term of this patent is extended or adjusted under 35 U.S.C. 154(b) by 0 days.

(21) Appl. No.: 19/169,256

(22) Filed: Apr. 3, 2025

Related U.S. Application Data

(63) Continuation-in-part of application No. 18/674,703, filed on May 24, 2024.

(51) Int. Cl.
*A47K 3/064* (2006.01)

(52) U.S. Cl.
CPC ..... *A47K 3/064* (2013.01)

(58) Field of Classification Search
CPC ..... A47K 3/064; A47K 3/062; A47K 3/06
USPC ..... 4/584
See application file for complete search history.

(56) References Cited

U.S. PATENT DOCUMENTS

| | | | | |
|---|---|---|---|---|
| 2,541,263 | A * | 2/1951 | Mayo | A47K 3/06 280/648 |
| 2,628,364 | A * | 2/1953 | Wallace | A47K 3/064 220/9.3 |
| 11,395,564 | B1 * | 7/2022 | Matias | A47K 3/064 |
| 12,178,367 | B1 * | 12/2024 | Chen | A47K 3/06 |
| 2015/0040309 | A1 * | 2/2015 | Sundberg | A47K 3/024 4/572.1 |

* cited by examiner

*Primary Examiner* — Huyen D Le
(74) *Attorney, Agent, or Firm* — Hawaii Patent Services; Nathaniel K. Fedde; Kenton N. Fedde

(57) ABSTRACT

This disclosure introduces a foldable bath frame comprising a body and a limiting assembly. The body consists of a first and second frame connected by a flexible seat. The limiting assembly at the bottom features a first mounting part on its first end, which detachably couples with the first frame's mounting cavity, and a second mounting part on its second end, pivotally connected to the second frame's mounting cavity. This design enables conversion between unfolded and folded states. The flexible seat deforms to facilitate folding/unfolding, while the limiting assembly's reinforced connections ensure both portability and structural stability, balancing convenience with durability in the foldable structure.

14 Claims, 14 Drawing Sheets

FOLDABLE BATH FRAME

CROSS-REFERENCE TO RELATED APPLICATIONS

This application is a continuation-in-part of U.S. patent application Ser. No. 18/674,703, filed on May 24, 2024, the entire contents of which are incorporated herein by reference.

TECHNICAL FIELD

The present disclosure relates to the technical field of baby products, and particularly to a foldable bath frame.

BACKGROUND

The existing bath frame designs often neglect the importance of portability and space utilization. Such bath frames are usually non-foldable, resulting in a large and fixed volume, which is particularly inconvenient during transportation and storage. During transportation, since the bath frames cannot be folded and shrunk, they occupy a large amount of space, which not only increases the loading difficulty of transport vehicles but also may lead to a significant increase in transportation costs.

Meanwhile, for household users, the bath frames still occupy a certain amount of storage space when not in use, which undoubtedly poses challenges to the tidiness and effective utilization of the home environment. To solve these problems, there is an urgent need to develop a foldable bath frame that can save space during transportation and storage, reduce transportation costs, and is also convenient for household users to store and use.

For example, the bath frames disclosed in the US patent with application No. 20230320534 and U.S. Pat. No. 11,627,842 have the above-mentioned problems. The bath frames cannot be folded, occupy a large amount of space during transportation and storage, and have relatively high transportation costs.

Based on this, it is necessary to propose a new type of bath frame that occupies less space, has low transportation costs, and is more convenient to store.

SUMMARY

To solve the above-mentioned technical problems, the present disclosure provides the following technical solutions:

The present disclosure provides a foldable bath frame, including a bath frame body with a foldable structure, wherein the bath frame body includes a first frame body and a second frame body connected to each other through a flexible connecting part, and the flexible connecting part is configured to allow the first frame body and the second frame body to perform state conversion between an unfolded state and a folded state; and a limiting assembly that is arranged at a bottom of the bath frame body and has an operable first connecting end and a pivotally connected second connecting end; wherein the second connecting end forms a pivotal connection with the second frame body through a pivot connection mechanism, and the first connecting end is configured with a locking mechanism that forms a releasable coupling with the first frame body; and the limiting assembly has a locked state and an unlocked state:

when in the locked state, the first connecting end forms a rigid coupling with the first frame body through the locking mechanism, and the limiting assembly provides rigid support for the first frame body and the second frame body, and restricts the relative rotational folding between the first frame body and the second frame body; and when in the unlocked state, the first connecting end is disengaged from the rigid coupling with the first frame body through the locking mechanism, releasing the rotational restriction on the first frame body and the second frame body, so that the first frame body and the second frame body are able to rotate and fold relative to each other around the flexible connecting part.

BRIEF DESCRIPTION OF DRAWINGS

The drawings, which form a part of this application, are used to provide a further understanding of the present disclosure. The schematic embodiments of the present disclosure and the descriptions thereof are used to explain the present disclosure and do not constitute an improper limitation of the present disclosure. In the drawings.

Figure 1:
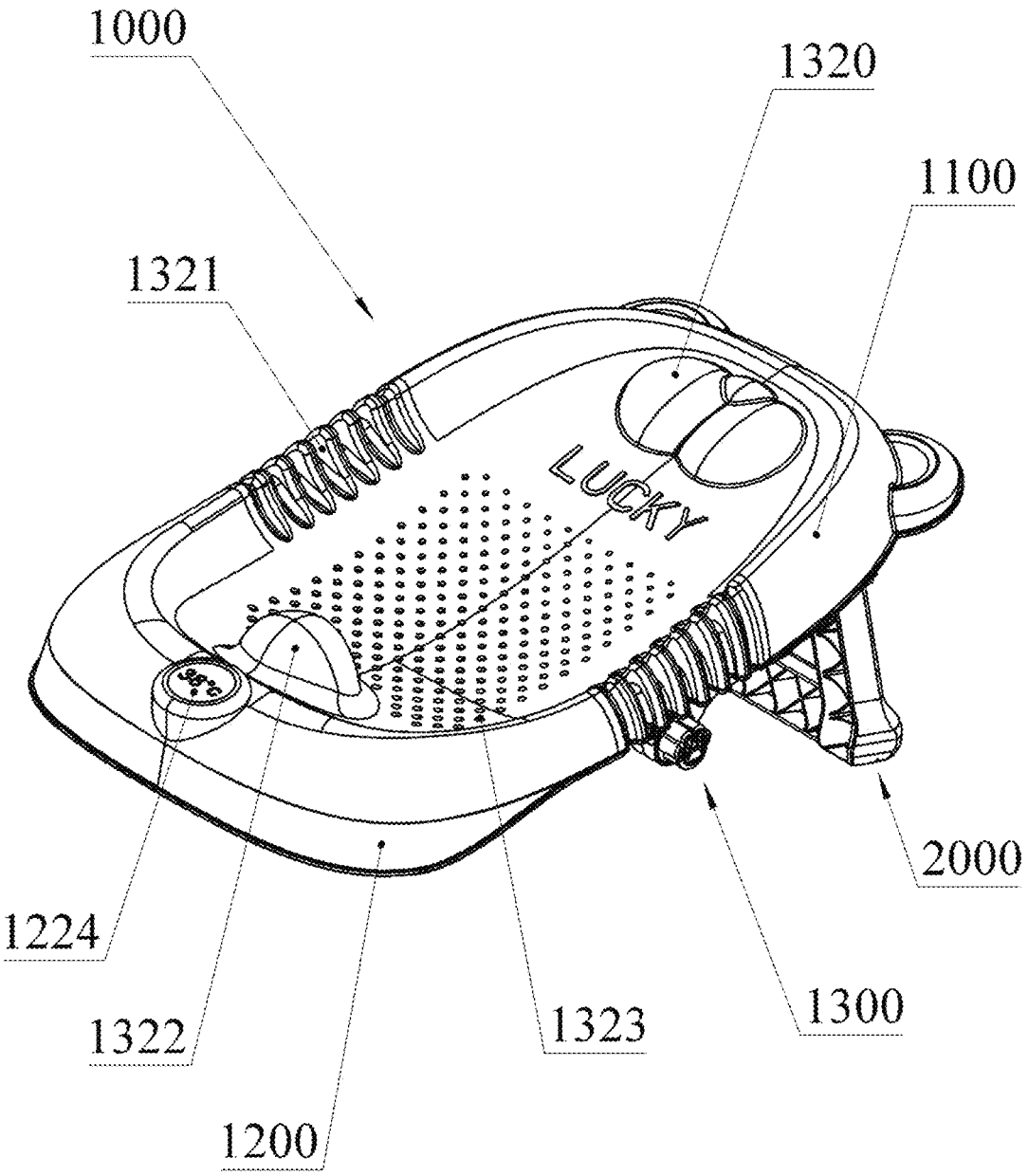
FIG. 1 is a schematic diagram of the foldable bath frame.

Reference signs in the drawings: Bath frame body (1000); First frame body (1100); First folding part (1110); First limiting hole (1111); First locking block (1112); First embedded block (1113); First embedded groove (1114); First fixing hole (1115); Second fixing hole (1116); First engagement ring (1117); First accommodating part (1118); First inner connecting ring (1119); First buckle protrusion (1120); Locking catch block (1121); Second inclined surface (1122); First tooth part (1123); First abutment end (1124); Mounting groove (1125); Rotating shaft hole (1126); Positioning hole (1127); Second frame body (1200); Second folding part (1210); Second limiting hole (1211); Second locking block (1212); Second embedded block (1213); Second embedded groove (1214); Third fixing hole (1215); Fourth fixing hole (1216); Second engagement ring (1217); Second accommodating part (1218); Second buckle protrusion (1219); ting ring (1220); Fixing snap ring (1221); Second tooth part (1222); Second abutment part (1223); Thermometer (1224);

Folding assembly (1300); Locking member (1310); Fixing protrusion (1311); Locking protrusion (1312); First inclined surface (1313); Seat part (1320); Corrugated part (1321); Seat protrusion (1322); Drainage hole (1323); Foot stand (2000); Rotating shaft part (2100); Positioning part (2200); Bath frame body (3000); First frame body (3100); First mounting cavity (3110); Clamping groove (3111); Second frame body (3200); Second mounting cavity (3210); Mounting hole (3211); Seat part (3300); Corrugated part (3310); Recess (3311); Limiting assembly (3400); First mounting part (3410); Elastic sheet (3411); Clamping protrusion (3412); Second mounting part (3420); Mounting protrusion (3421); Rib (3430).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 11, the present disclosure provides a foldable bath frame. The foldable bath frame includes a bath frame body 1000 and a foot stand 2000 detachably connected to one end of the bath frame body 1000. The bath frame body 1000 includes a first frame body 1100, a second frame body 1200, and a folding assembly 1300 connecting the first frame body 1100 and the second frame body 1200. The first frame body 1100 and the second frame body 1200 are unfolded or folded through the folding assembly 1300;

The folding assembly 1300 includes a first folding part 1110 provided on the first frame body 1100, a second folding part 1210 provided on the second frame body 1200, and a locking member 1310. A first limiting hole 1111 is provided in the first folding part 1110, and a first locking block 1112 is formed in the first limiting hole 1111. A second limiting hole 1211 corresponding to the first limiting hole 1111 is provided in the second folding part 1210, and a second locking block 1212 is formed in the second limiting hole 1211 in the direction close to the first locking block 1112. The locking member 1310 is inserted through the first limiting hole 1111 and the second limiting hole 1211, and makes the first folding part 1110 and the second folding part 1210 rotatably connected.

When the first folding part 1110 and the second folding part 1210 rotate relative to each other until the first frame body 1100 and the second frame body 1200 are unfolded, the second locking block 1212 abuts against the first locking block 1112 and locks the first frame body 1100 and the second frame body 1200.

This embodiment provides a foldable bath frame, which has an exquisite structure, is easy to carry, and can provide stable support during use, meeting various needs of users during bathing.

In this embodiment, the foldable bath frame mainly consists of two parts: the bath frame body and the foot stand. The bath frame body is further composed of a first frame body, a second frame body, and a folding assembly connecting the two. This design allows the bath frame body to be easily unfolded and folded, thus adapting to different usage environments and storage requirements.

In this embodiment, a first folding part is provided on the first frame body, and a second folding part is provided on the second frame body. These two parts are rotatably connected by a locking member, realizing the folding and unfolding functions of the bath frame body. Meanwhile, to ensure stability in the unfolded state, a first limiting hole is provided in the first folding part, and a first locking block is formed therein. Correspondingly, a second limiting hole corresponding to the first limiting hole is provided in the second folding part, and a second locking block is formed therein in the direction close to the first locking block. When the first folding part and the second folding part rotate relative to each other until the bath frame body is fully unfolded, the second locking block will abut against the first locking block, effectively locking the first frame body and the second frame body and ensuring the stability of the bath frame during use.

The advantage of this foldable bath frame is that it has a compact structure, a small volume after folding, and is easy to carry and store. At the same time, the unfolded bath frame body has a stable structure and can bear a certain weight, meeting the needs of users for placing bathing supplies and supporting the body. In addition, due to the detachable foot stand design, users can choose whether to install the foot stand according to actual needs, further increasing the flexibility and applicability of the bath frame.

As shown in FIG. 1, in this embodiment, a flexible seat part 1320 is provided on the first frame body 1100 and the second frame body 1200. The seat part 1320 deforms as the first frame body 1100 and the second frame body 1200 are unfolded or folded. The seat part 1320 is provided with a corrugated part 1321, and the corrugated part 1321 is configured on the folding assembly 1300 and deforms as the first frame body 1100 and the second frame body 1200 are unfolded or folded.

Specifically, this foldable bath frame is provided with a flexible seat part on the first frame body and the second frame body. This design allows users to have a comfortable and stable seat during bathing, greatly improving the convenience and comfort of bathing. When the bath frame body is in the folded state, the seat part can deform accordingly, maintaining its flexibility and foldability without affecting the overall portability and storage of the bath frame. When the bath frame body is unfolded, the seat part returns to its original shape, providing a flat and stable sitting surface for users.

In this embodiment, the seat part is also provided with corrugated parts, which are ingeniously configured on the folding assembly. This design enables the seat part to better adapt to the deformation of the first frame body and the second frame body during the folding and unfolding processes, maintaining the stability of its shape and function. Meanwhile, the presence of the corrugated parts also increases the elasticity and durability of the seat part, allowing it to withstand more usage pressure and wear, thus extending the service life of the bath frame.

The advantage of this improved foldable bath frame is that it not only inherits the advantages of traditional foldable bath frames in terms of portability and storage but also innovates in terms of user experience. By setting the flexible seat part and corrugated parts, the bath frame can provide stable support while bringing a more comfortable and convenient bathing experience to users. Whether at home, during travel, or in other occasions where temporary bathing is needed, this improved foldable bath frame can bring great convenience and comfort to users.

As shown in FIG. 1, in this embodiment, a thermometer 1224 is provided on the second frame body 1200.

Specifically, the setting of the thermometer enables users to conveniently obtain water temperature information during bathing. By observing and reading the data on the thermometer, users can accurately judge whether the temperature of the bath water is suitable, thus avoiding discomfort or safety hazards caused by excessively high or low water temperature.

In addition, the design of the thermometer also takes into account the user's convenience of use. It is ingeniously installed on the second frame body, neither taking up too much space nor affecting the overall aesthetics of the bath frame. Meanwhile, the reading method of the thermometer is simple and clear, and users can easily obtain the required information without additional operations or adjustments.

The benefits brought by this improved foldable bath frame are multi-faceted. Firstly, it enhances the safety of bathing. By accurately grasping the water temperature information, users can avoid problems such as scalding or catching a cold caused by improper water temperature, ensuring their own health and safety. Secondly, it improves the comfort of bathing. Users can adjust the temperature of the bath water according to their own preferences and needs, enjoying a more comfortable and pleasant bathing experience. Finally, it also enhances the practicality and functionality of the bath frame. The presence of the thermometer makes the bath frame not just a simple bathing tool but also an intelligent device that can provide all-round services and meet various needs of users.

In other embodiments (not shown), special hooks are provided on one side or the top of the bath frame for hanging the shower head. This allows users to adjust the position and height of the shower head during bathing, making the bathing experience more flexible and comfortable. A storage basket is added below or on the side of the bath frame for storing bathing supplies such as shampoo, body wash, soap, etc. This helps keep the bathing space tidy and allows users to easily access the items they need at any time. A massage pad or massage points are added to the seat part to provide the function of relieving muscle fatigue. Users can enjoy the comfort brought by the massage during bathing and further relax their body and mind. Non-slip pads are installed at the bottom of the seat part and the foot stand to increase the friction with the ground, preventing the bath frame from sliding or tipping over during use and ensuring the safety of users. An integrated intelligent control system, such as Bluetooth connection and voice control, is provided, enabling users to control the functions of the bath frame, such as water temperature adjustment and shower head switch, through mobile phones or other smart devices, enhancing the convenience and intelligence level of use.

Figure 2:
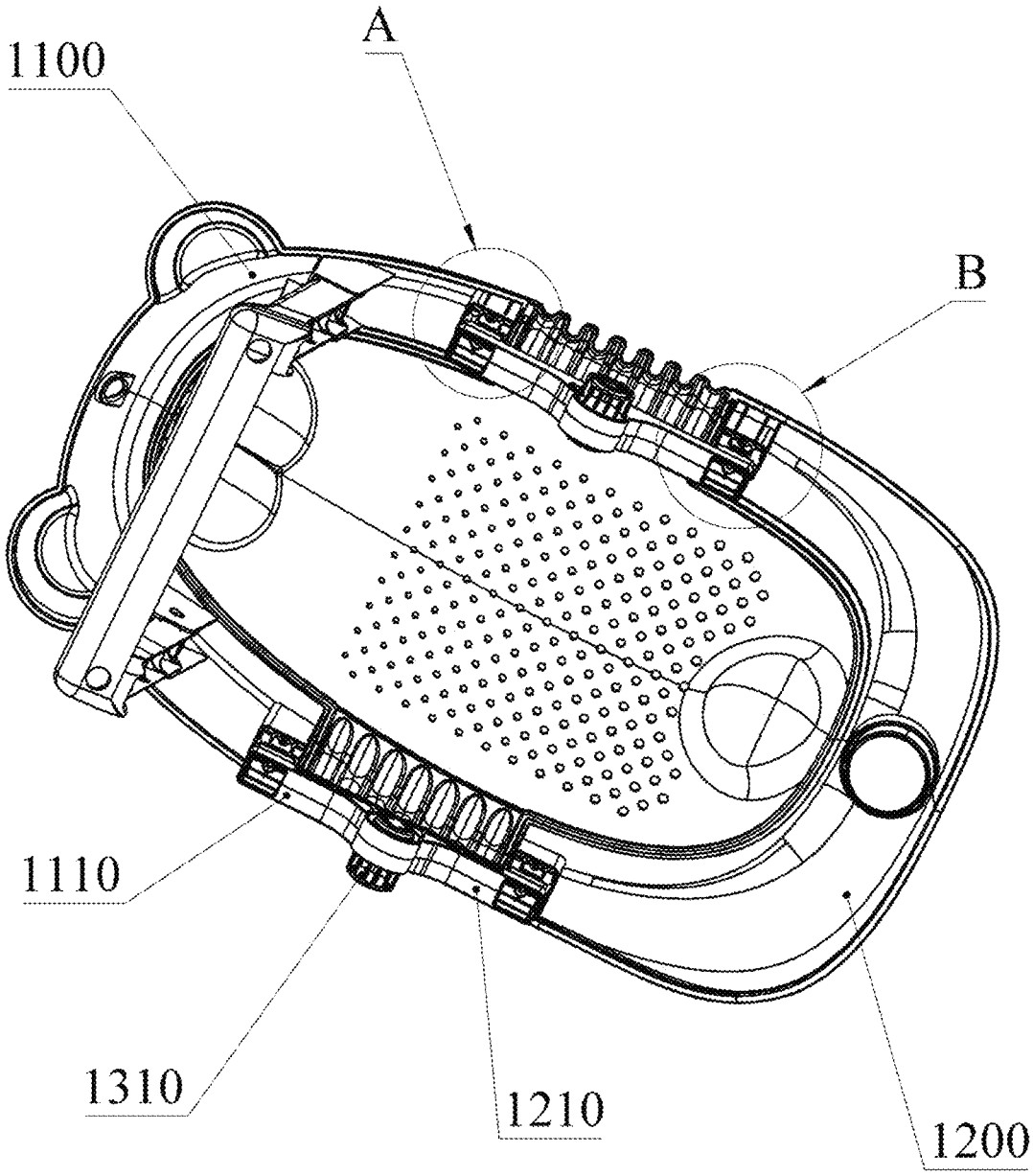
FIG. 2 is another schematic diagram of the foldable bath frame.
Figure 3:
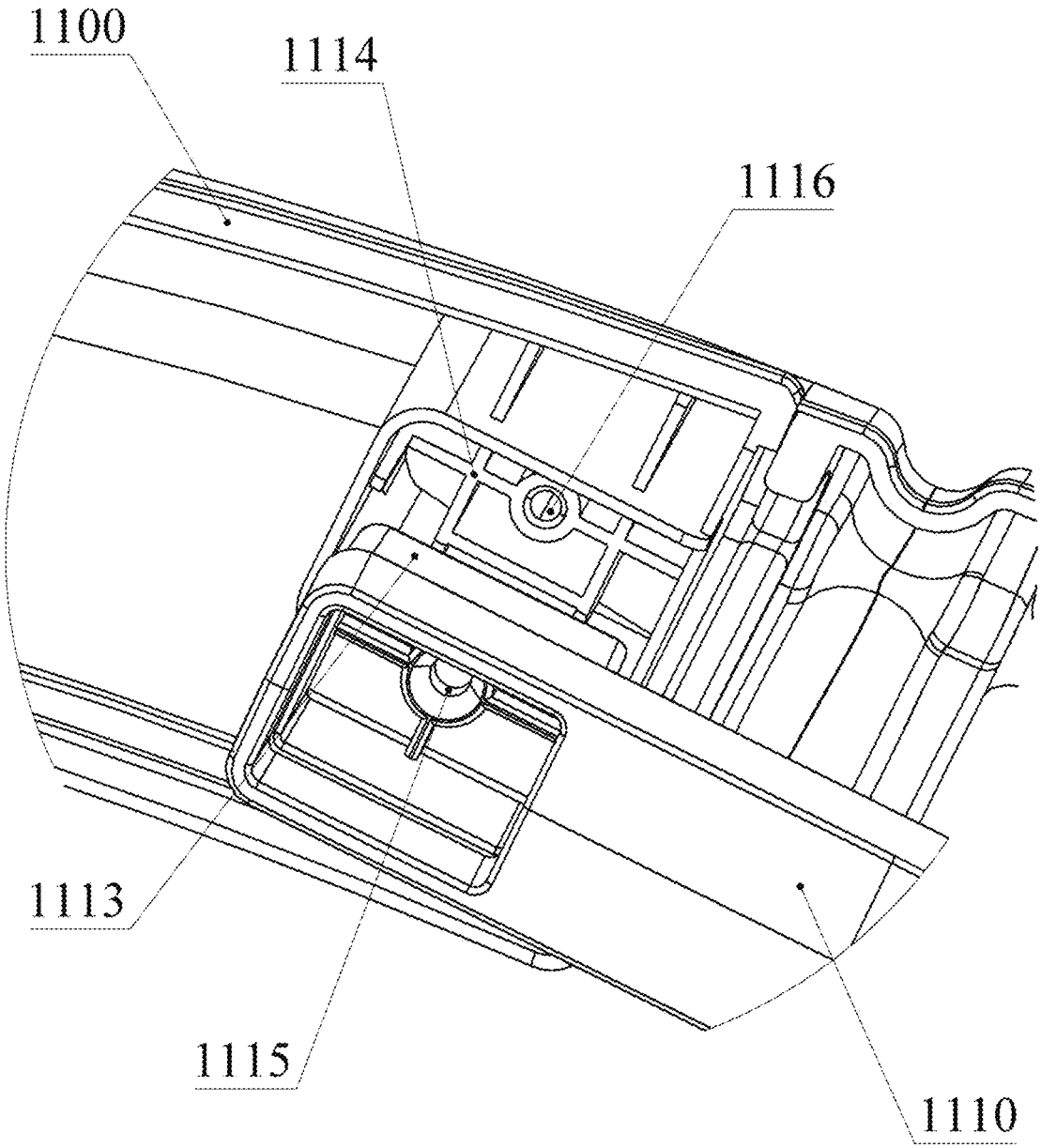
FIG. 3 is an enlarged schematic diagram of part A in FIG. 2.

As shown in FIGS. 2 to 3, in this embodiment, a first embedded block 1113 is formed on the first folding part 1110. At least one first embedded groove 1114 is provided at the lower end of the first frame body 1100. The first embedded groove 1114 is shaped to correspond to the first embedded block 1113. A first fixing hole 1115 is formed in the first embedded block 1113, and a second fixing hole 1116 is formed in the first embedded groove 1114. Here, the first folding part 1110 and the first frame body 1100 are fixedly connected through the first embedded block 1113, the first embedded groove 1114 and the first fixing member.

Specifically, a first embedded block is formed on the first folding part. This design makes the structure of the first folding part more complete and also facilitates the subsequent connection with the first frame body. At the lower end of the first frame body, at least one first embedded groove is provided. The shape of these embedded grooves matches that of the first embedded block, ensuring that they can be tightly fitted together.

To further enhance the stability of the connection, a first fixing hole is formed in the first embedded block, and a second fixing hole is formed in the corresponding first embedded groove. The provision of these two fixing holes allows the first folding part and the first frame body to be firmly connected together through the first fixing member (such as screws, pins, etc.). This connection method is not only simple in structure but also reliable in connection effect, effectively preventing the bath frame from loosening or deforming during use.

The benefits brought by this improved foldable bath frame are multi-faceted. First of all, through the chimeric design of the first embedded block and the first embedded groove, the structure of the bath frame is more stable, capable of withstanding greater weight and impact force, thereby extending the service life of the bath frame. Secondly, this connection method facilitates disassembly and assembly. Users can easily disassemble or reassemble the bath frame as needed, which is convenient for carrying and storage. In addition, due to the adoption of the in-built design, the appearance of the bath frame is neater and more beautiful, meeting the aesthetic needs of modern homes.

In this embodiment, the first folding part and the first frame body form a fixed connection through the first embedded block, the first embedded groove and the first fixing member. In other embodiments (not shown), the first folding part and the first frame body are not limited to forming a fixed connection through the first embedded block, the first embedded groove and the first fixing member. They can also be set as snap connection, welding, riveting and any other desirable connection methods.

Figure 4:
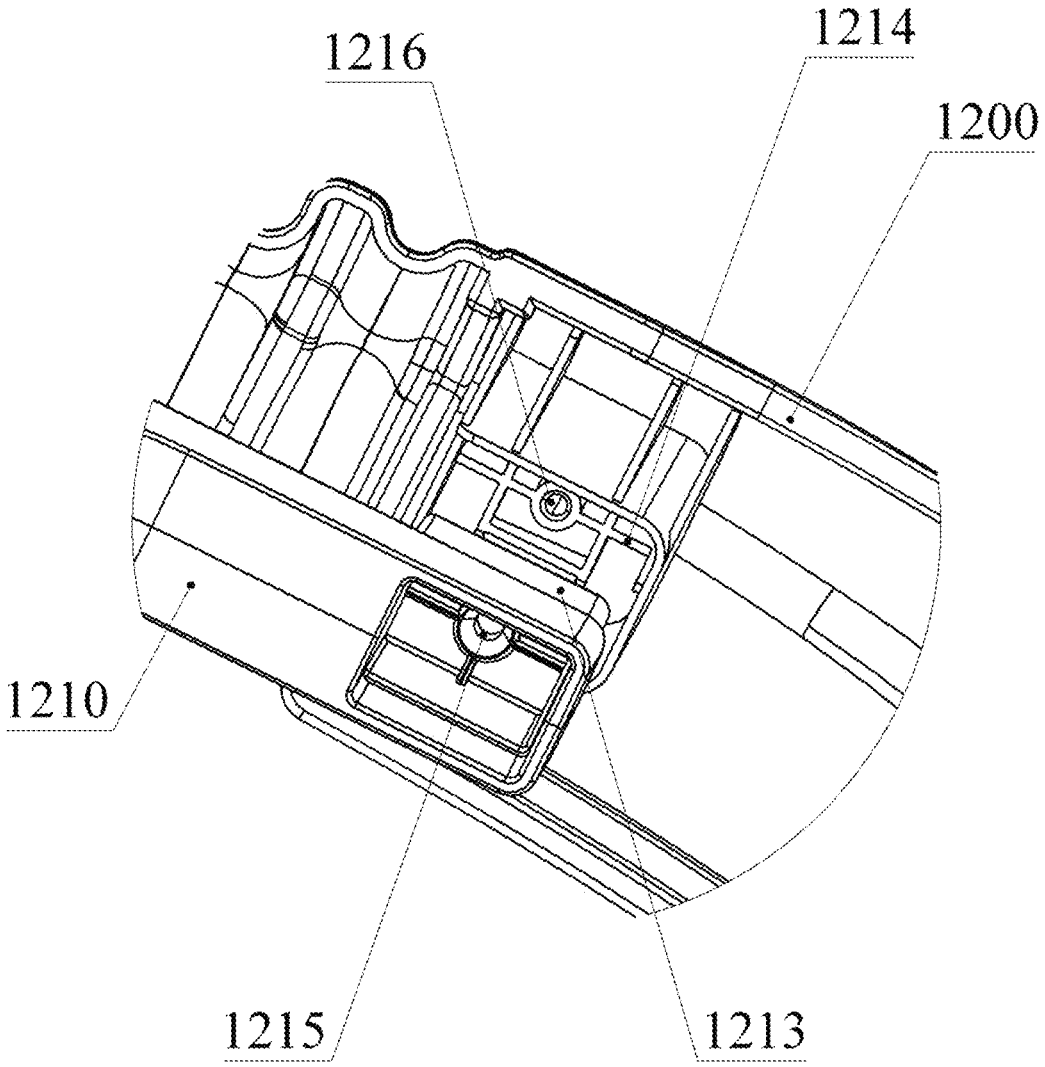
FIG. 4 is an enlarged schematic diagram of part B in FIG. 2.
Figure 5:
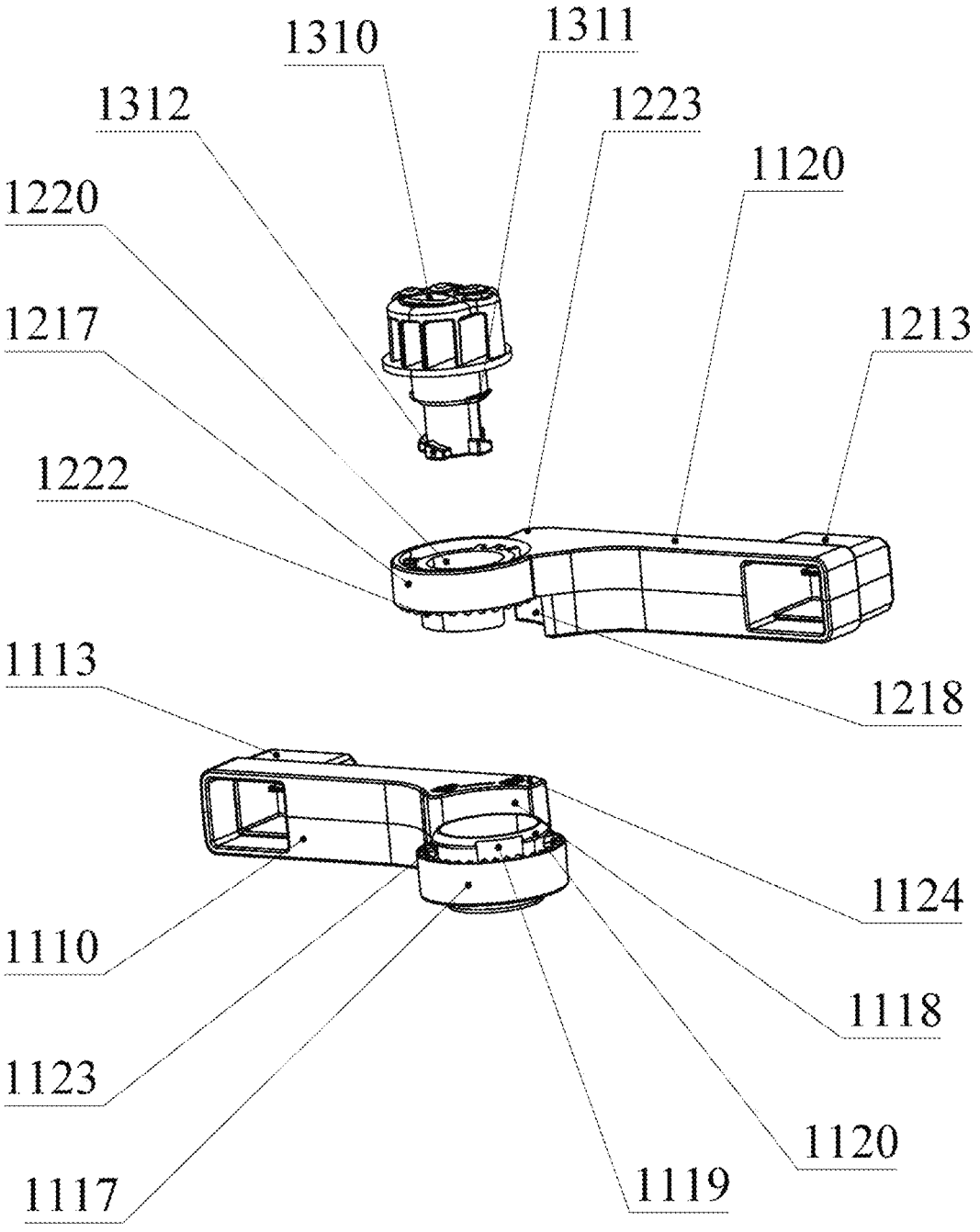
FIG. 5 is a schematic diagram of the folding assembly.
Figure 6:
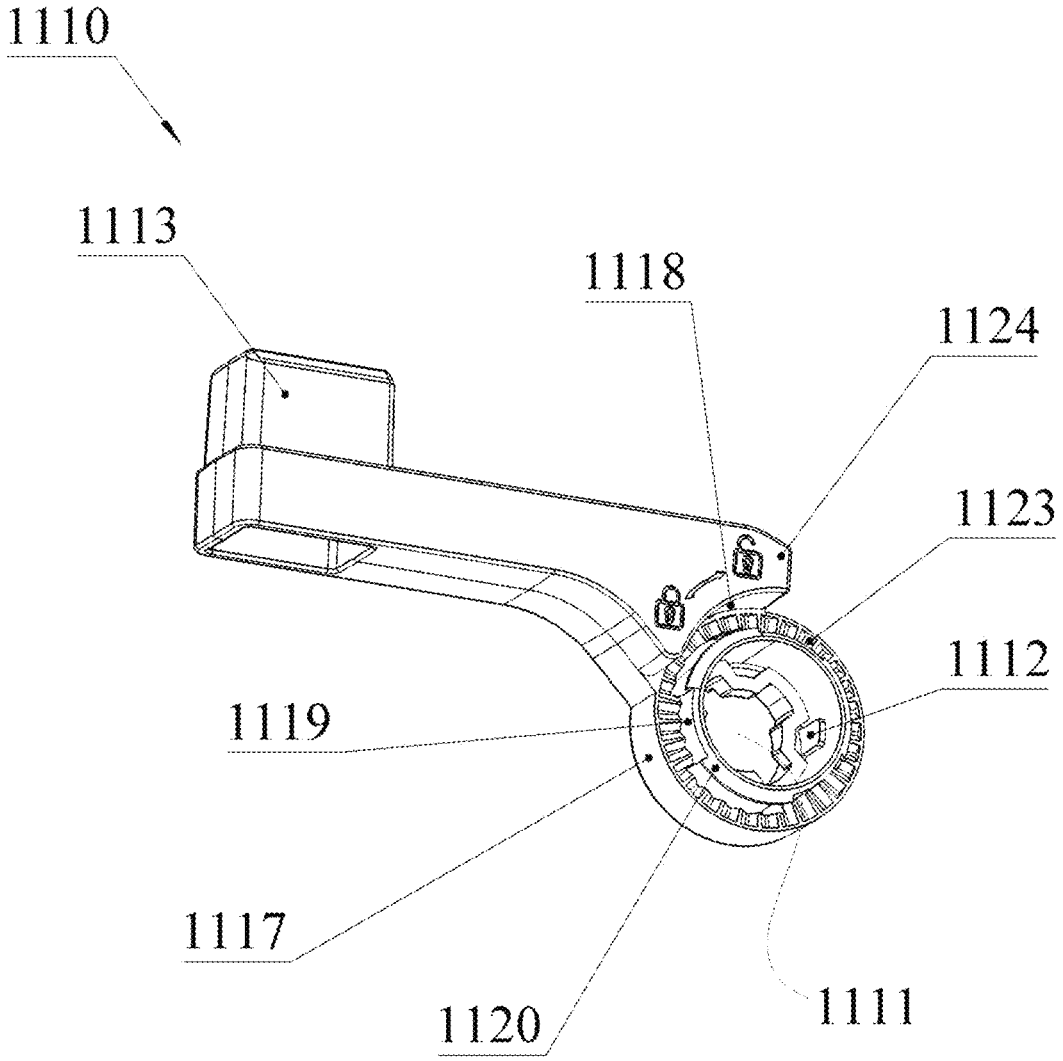
FIG. 6 is a schematic diagram of the first folding part.
Figure 7:
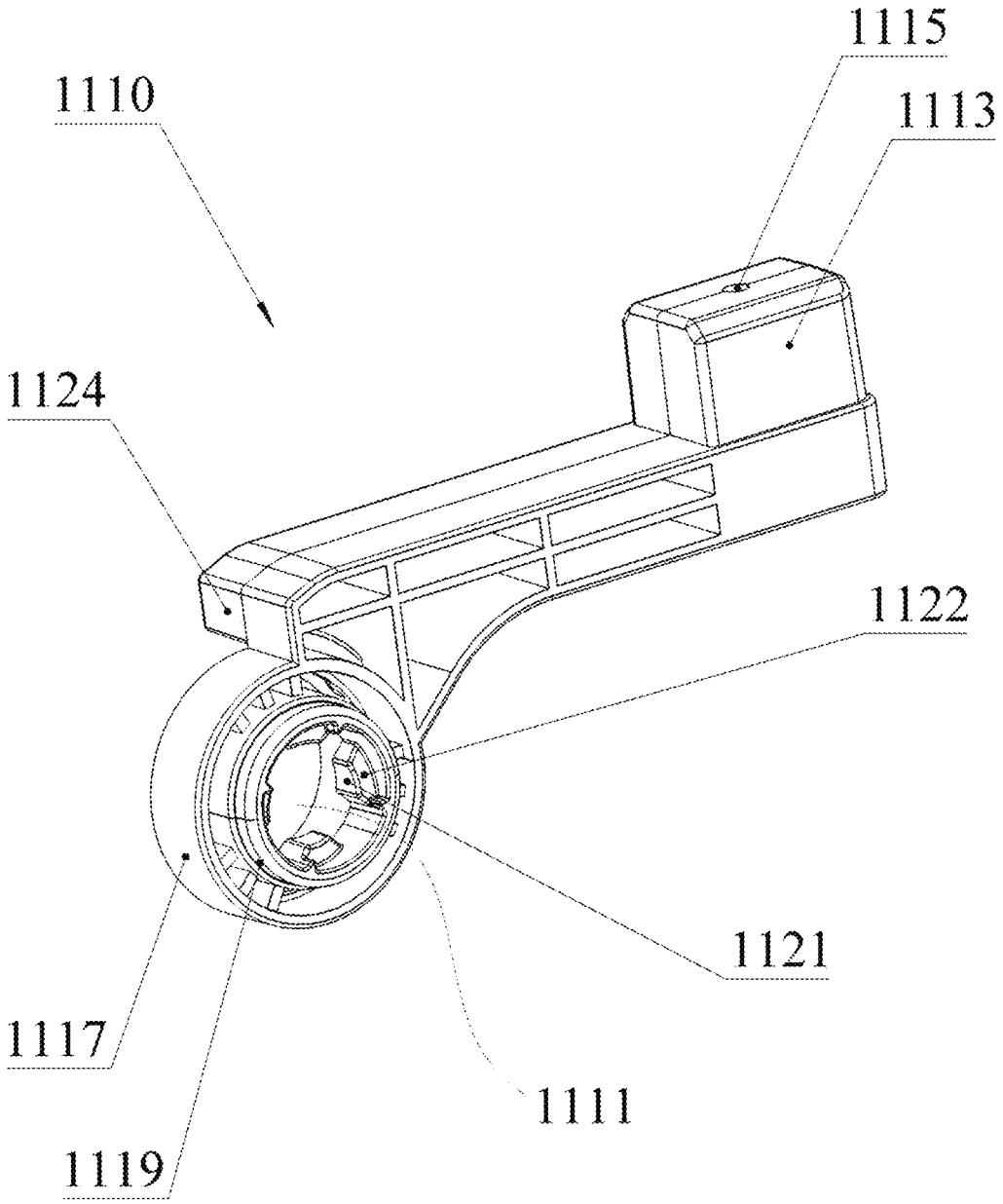
FIG. 7 is another schematic diagram of FIG. 6.
Figure 8:
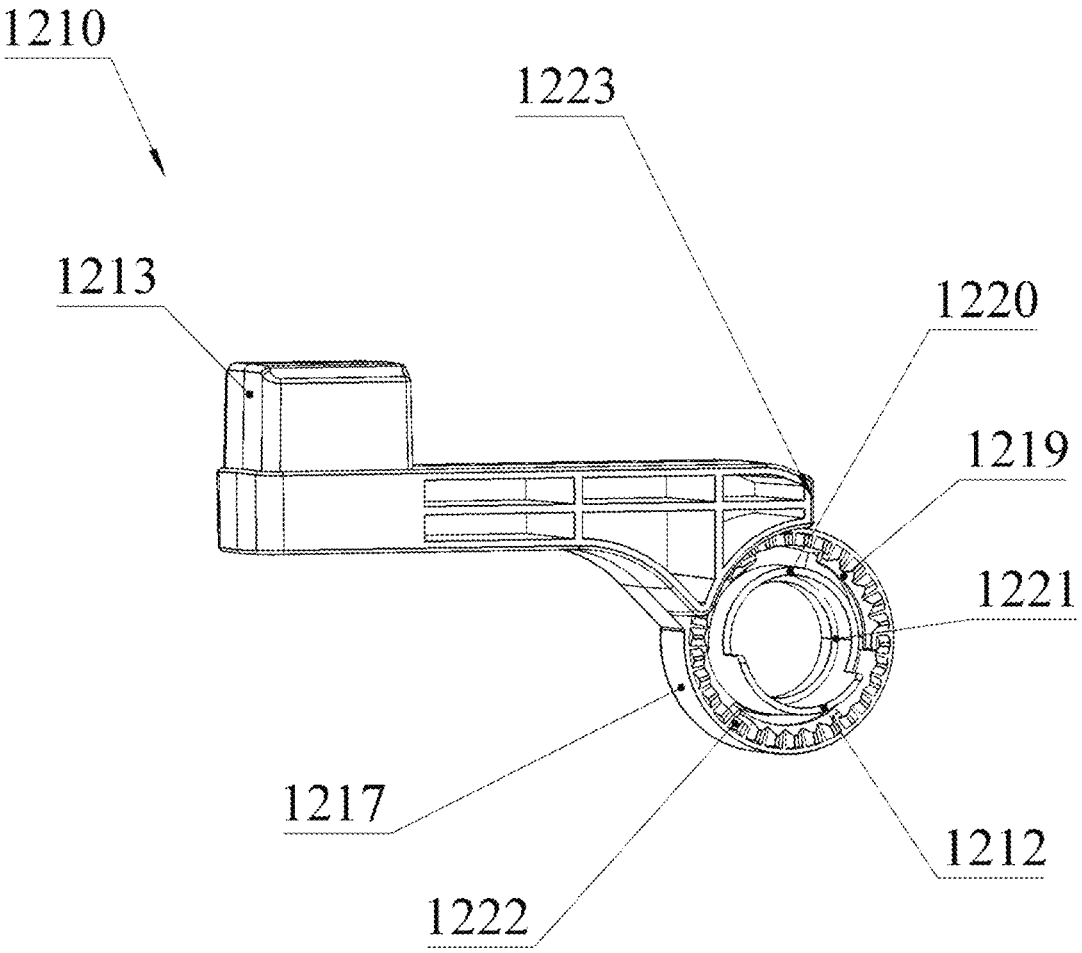
FIG. 8 is a schematic diagram of the second folding part.
Figure 9:
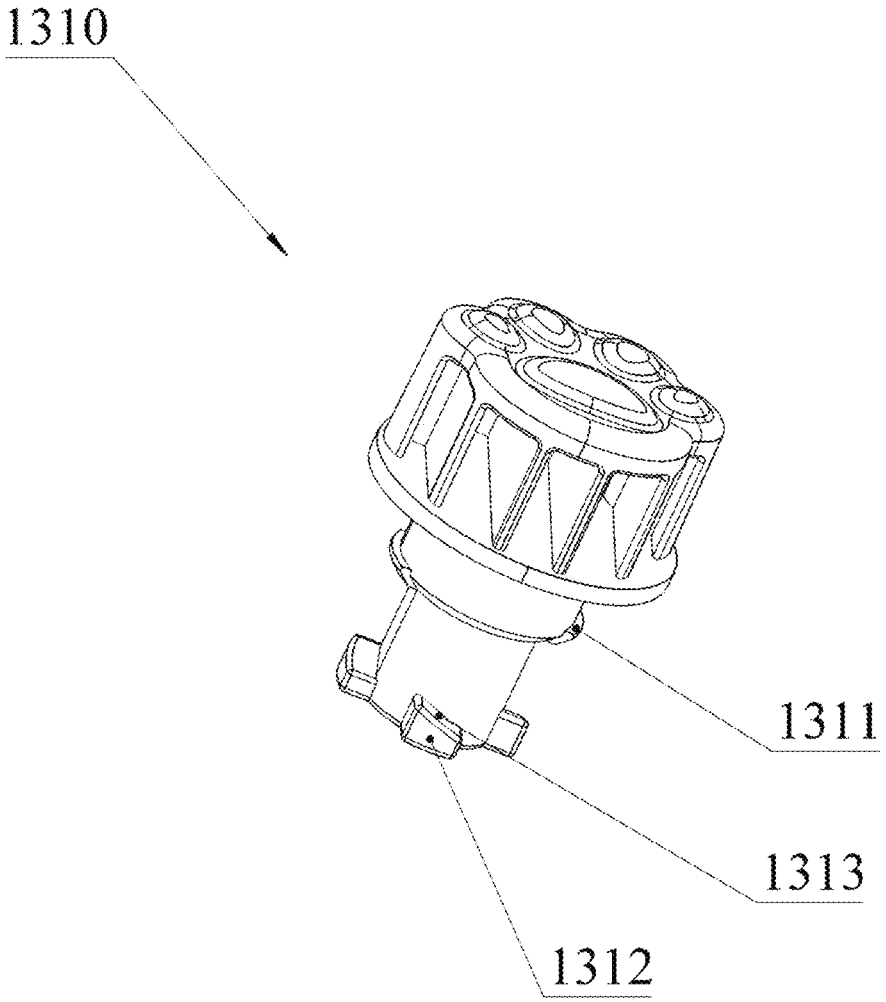
FIG. 9 is a schematic diagram of the locking member.

As shown in FIGS. 2 to 4, in this embodiment, a second embedded block 1213 is formed on the second folding part 1210. At least one second embedded groove 1214 is provided at the lower end of the second frame body 1200. The second embedded groove 1214 is set to correspond to the shape of the second embedded block 1213. A third fixing hole 1215 is formed in the second embedded block 1213, and a fourth fixing hole 1216 is formed in the second embedded groove 1214. Among them, the second folding part 1210 and the second frame body 1200 form a fixed connection through the second embedded block 1213, the second embedded groove 1214 and the second fixing member.

Specifically, a second embedded block is formed on the second folding part. This design makes the second folding part more stable in structure and provides effective support for the connection with the second frame body. At the same time, at the lower end of the second frame body, at least one second embedded groove is provided. The shape of these embedded grooves precisely matches the second embedded block, ensuring that the two can be tightly fitted together to form a stable connection structure.

In order to further enhance the stability of the connection, a third fixing hole is designed in the second embedded block, and a fourth fixing hole is formed in the corresponding second embedded groove. The setting of these two fixing holes allows the second folding part to be firmly connected to the second frame body together through the second fixing member (such as screws, pins, etc.). This connection method is not only simple and effective, but also has a reliable connection effect, ensuring that the bath frame will not loosen or deform during use.

This improved foldable bath frame brings many benefits. First, through the chimeric design of the second embedded block and the second embedded groove, the structure of the bath frame is more stable, capable of withstanding greater weight and impact force, thereby extending the service life of the bath frame. Second, this connection method greatly simplifies the disassembly and assembly process of the bath frame, and users can easily disassemble or reassemble the bath frame as needed, which is convenient for carrying and storage. In addition, due to the in-built design, the appearance of the bath frame is neater and more beautiful, meeting the aesthetic needs of modern homes.

In this embodiment, the second folding part and the second frame body form a fixed connection through the second embedded block, the second embedded groove, and the second fixing member. In other embodiments (not shown), the first folding part and the first frame body are not limited to forming a fixed connection through the first embedded block, the first embedded groove, and the first fixing member. The connection between them can also be set as snap-fit connection, welding, riveting, and any other desirable connection methods.

As shown in FIGS. 5 to 8, in this embodiment, a first engagement ring 1117 and a first accommodating part 1118 are formed on the first folding part 1110. The first accommodating part 1118 is set to accommodate the second engagement ring 1217. A second engagement ring 1217 and a second accommodating part 1218 are formed on the second folding part 1210. The second accommodating part 1218 is set to accommodate the first engagement ring 1117. The second engagement ring 1217 is configured in the first accommodating part 1118, and the first engagement ring 1117 is configured in the second accommodating part 1218.

Specifically, a first engagement ring and a first accommodating part are formed on the first folding part. As a fixed structure, the first engagement ring provides a stable support point for the connection. The first accommodating part is set to accommodate the second engagement ring. This design allows the second folding part to be tightly embedded in it, forming a stable connection.

At the same time, a second engagement ring and a second accommodating part are formed on the second folding part. The second engagement ring corresponds to the first engagement ring. Through the cooperation of the two, a tight connection between the first folding part and the second folding part is achieved. The second accommodating part is set to accommodate the first engagement ring. This design allows the first folding part to be smoothly embedded in it, further enhancing the stability of the connection.

In practical applications, the second engagement ring is configured in the first accommodating part, and the first engagement ring is configured in the second accommodating part. This configuration method enables the foldable bath frame to remain stable during the unfolding and folding processes and is not prone to loosening or misalignment. At the same time, the combination of the engagement ring and the accommodating part also has a certain degree of elasticity, which can adapt to adjustments at different angles and forces, allowing users to experience a smoother and more comfortable operation process.

As shown in FIGS. 5 to 8, in this embodiment, a first inner connecting ring 1119 is formed on the first engagement ring 1117 in the direction approaching the second engagement ring 1217. The first inner connecting ring 1119 is configured to allow entry into the second engagement ring 1217. A first buckle protrusion 1120 is formed on the first inner connecting ring 1119, and a second buckle protrusion 1219 is provided in the second engagement ring 1217. The first engagement ring 1117 and the second engagement ring 1217 form a movable connection through the first inner connecting ring 1119, the first buckle protrusion 1120 and the second buckle protrusion 1219.

Specifically, in the direction of the first engagement ring approaching the second engagement ring, a first inner connecting ring is ingeniously designed. This inner connecting ring is configured to allow entry into the interior of the second engagement ring, forming a tight fitting structure. Such a design enables the first engagement ring and the second engagement ring to fit more closely together when connected, enhancing the overall stability.

In order to further improve the firmness of the connection, we have formed first buckle protrusions on the first inner connecting ring. These buckle protrusions have a certain degree of elasticity and toughness and can be firmly embedded in the second engagement ring to form an effective buckle connection. At the same time, corresponding second buckle protrusions are also provided in the second engagement ring. They cooperate with the first buckle protrusions to jointly form a stable movable connection structure.

With this movable connection method combining the inner connecting ring and the buckle protrusions, the first engagement ring and the second engagement ring can achieve a fast and firm connection. Users only need to simply insert the first inner connecting ring into the second engagement ring and ensure that the first buckle protrusions and the second buckle protrusions are mutually embedded to complete the connection process. This connection method is not only simple and convenient to operate, but also has a reliable connection effect, which can effectively prevent the bath frame from loosening or falling off during use.

As shown in FIGS. 5 to 8, in this embodiment, a second inner connecting ring 1220 is formed inward on the second engagement ring 1217. The second inner connecting ring 1220 is configured to allow entry into the first inner connecting ring 1119. A second locking block 1212 is formed on the inner connecting ring in the direction approaching the first inner connecting ring 1119, and a first locking block 1112 is formed in the first inner connecting ring 1119. At least part of the first locking block 1112 is allowed to abut against the second locking block 1212.

Specifically, a second inner connecting ring is formed inward on the second engagement ring. This design makes the structure of the second engagement ring more complete and also provides the possibility for a close fit with the first inner connecting ring. The second inner connecting ring is configured to allow entry into the first inner connecting ring. This nested structure enables the first engagement ring and the second engagement ring to form a closer and more stable structure when connected.

To further enhance the stability of the connection, a second locking block is formed on the second inner connecting ring in the direction approaching the first inner connecting ring. The design of these locking blocks has certain geometric shapes and sizes, which can form an effective fit with the first locking block in the first inner connecting ring. Meanwhile, corresponding first locking blocks are also formed in the first inner connecting ring, and At least part of the locking blocks is allowed to abut against the second locking block.

In actual use, when the second engagement ring is connected to the first engagement ring, the second inner connecting ring will enter the first inner connecting ring, and at the same time, the second locking block will abut against the first locking block. This abutment mechanism not only increases the stability of the connection but also prevents the bathtub rack from accidentally loosening or deforming during use.

As shown in FIGS. 5 to 8, in this embodiment, a first limiting hole 1111 is provided in the first inner connecting ring 1119, and a second limiting hole 1211 is provided in the second inner connecting ring 1220. The locking member 1310 passes through the second limiting hole 1211 and the first limiting hole 1111 in sequence. The first folding part 1110 and the second folding part 1210 are rotatably connected through the locking member 1310.

Specifically, a first limiting hole is carefully provided in the first inner connecting ring. This design enables the locking member to accurately pass through and be fixed at this position, providing a stable foundation for the subsequent rotational connection. Meanwhile, a corresponding second limiting hole is also provided in the second inner connecting ring. These limiting holes correspond to the first limiting hole in position and jointly provide a path for the locking member to pass through.

In practical applications, the locking member is designed to pass through the second limiting hole and the first limiting hole in sequence. This step is simple and straightforward. Users only need to align the locking member with the limiting holes and gently push it in to complete the installation. In this way, a tight rotational connection is formed between the first folding part and the second folding part. This connection is not only stable and reliable but also allows the two to rotate freely within a certain range, thereby realizing the folding and unfolding functions of the bathtub rack.

As shown in FIGS. 5 to 9, in this embodiment, at least one fixing protrusion 1311 and a locking protrusion 1312 are formed on the locking member 1310. A fixing snap ring 1221 is formed in the second inner connecting ring 1220. The fixing snap ring 1221 corresponds to the fixing protrusion 1311. The locking member 1310 and the second folding part 1210 form a snap connection.

At least one locking catch block 1121 is formed in the first inner connecting ring 1119. The locking catch block 1121 corresponds to the locking protrusion 1312. A first inclined surface 1313 is formed on the locking protrusion 1312, and a second inclined surface 1122 is formed on the locking catch block 1121. The second inclined surface 1122 corresponds to the first inclined surface 1313. The locking member 1310, the first folding part 1110, and the second folding part 1210 form a lock.

Specifically, at least one fixing protrusion and a locking protrusion are formed on the locking member. The shapes and sizes of these protrusions are carefully designed to ensure that they can precisely cooperate with other components. The fixing protrusion corresponds to the fixing snap ring in the second inner connecting ring. When the locking member penetrates the second limiting hole, the fixing protrusion will closely fit with the fixing snap ring, forming a stable fixed connection. This design makes the locking member less likely to loosen or fall off when under stress, enhancing the stability of the bathtub rack structure.

Meanwhile, the locking protrusions on the locking member correspond to the locking catch blocks in the first inner connecting ring. Through the specific shape and angle design of these locking protrusions and locking catch blocks, the function of snap connection is realized. A first inclined surface is formed on the locking protrusion, and a corresponding second inclined surface is formed on the locking catch block. When the locking member is pushed into place, the first inclined surface and the second inclined surface will contact each other and generate a certain amount of friction, enabling the locking member to be firmly fixed in the first inner connecting ring. This design not only enhances the stability of the connection but also makes the operation smoother and more labor-saving.

As shown in FIGS. 5 to 8, in this embodiment, a first tooth part 1123 is provided at one end of the first inner connecting ring 1119 close to the second inner connecting ring 1220, and a second tooth part 1222 is provided at one end of the second inner connecting ring 1220 close to the first inner connecting ring 1119. The second tooth part 1222 and the first tooth part 1123 are engaged with each other.

Specifically, at one end of the first inner connecting ring close to the second inner connecting ring, the first tooth part is elaborately provided. These tooth parts are arranged according to a certain pattern and spacing, forming a unique meshing structure. Meanwhile, at one end of the second inner connecting ring close to the first inner connecting ring, a corresponding second tooth part is also provided. The shape, size and arrangement of the second tooth part match those of the first tooth part, enabling the two to mesh with each other.

In practical applications, when the first inner connecting ring is butted with the second inner connecting ring, the first tooth part and the second tooth part will contact and tightly mesh with each other. This meshing mechanism enables the first folding part and the second folding part to form a more stable and firm structure when connected. Due to the presence of the tooth parts, even under the action of external forces, the two inner connecting rings are not easy to separate or loosen, thus ensuring the overall stability of the bath frame.

In addition, the tooth part design also improves the convenience and accuracy of operation. Users only need to gently butt the two inner connecting rings, and the tooth parts will automatically mesh without additional adjustment or fixing operations. At the same time, the meshing structure of the tooth parts also has a certain guiding effect, which can help users complete the butting action more accurately, improving the accuracy and efficiency of the operation.

As shown in FIGS. 5 to 8, in this embodiment, the first folding part 1110 has a first abutment end 1124, and the second folding part 1210 has a second abutment part 1223. When the first folding part 1110 and the second folding part 1210 rotate relative to each other until the first frame body 1100 and the second frame body 1200 are unfolded, the first abutment end 1124 and the second abutment part 1223 abut against each other.

Specifically, the first folding part is equipped with a first abutment end, while the second folding part has a second abutment part. These two abutment ends and abutment parts are precisely designed and configured to contact and produce an abutment effect under specific operating conditions.

When the user needs to unfold the bath frame, they will perform corresponding operations to make the first folding part and the second folding part rotate relative to each other. As the rotation progresses, the first frame body and the second frame body gradually unfold until they reach a predetermined unfolded state. During this process, the first abutment end and the second abutment part will approach each other and finally achieve abutment.

Figure 10:
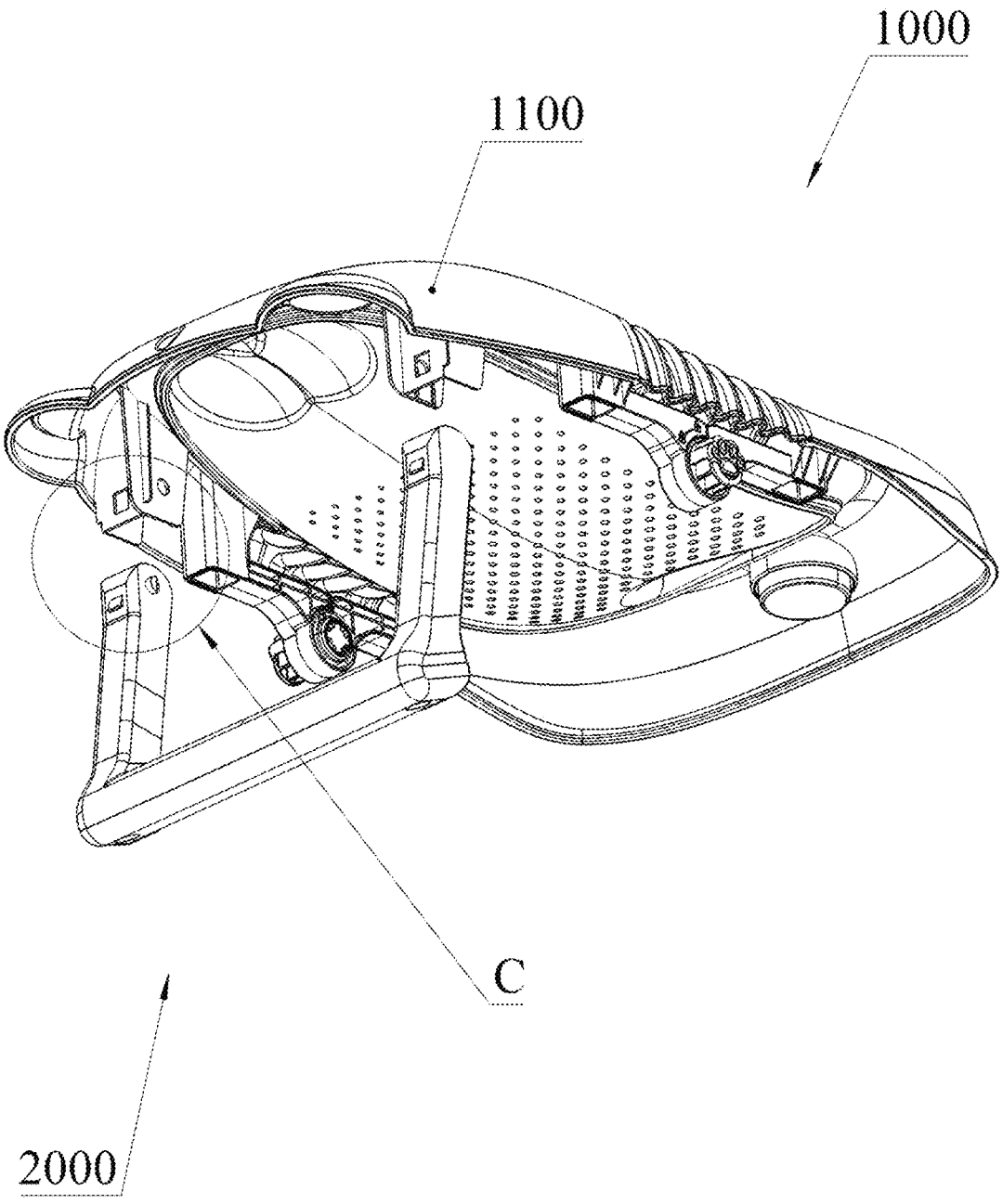
FIG. 10 is a partial exploded view of the foldable bath frame.
Figure 11:
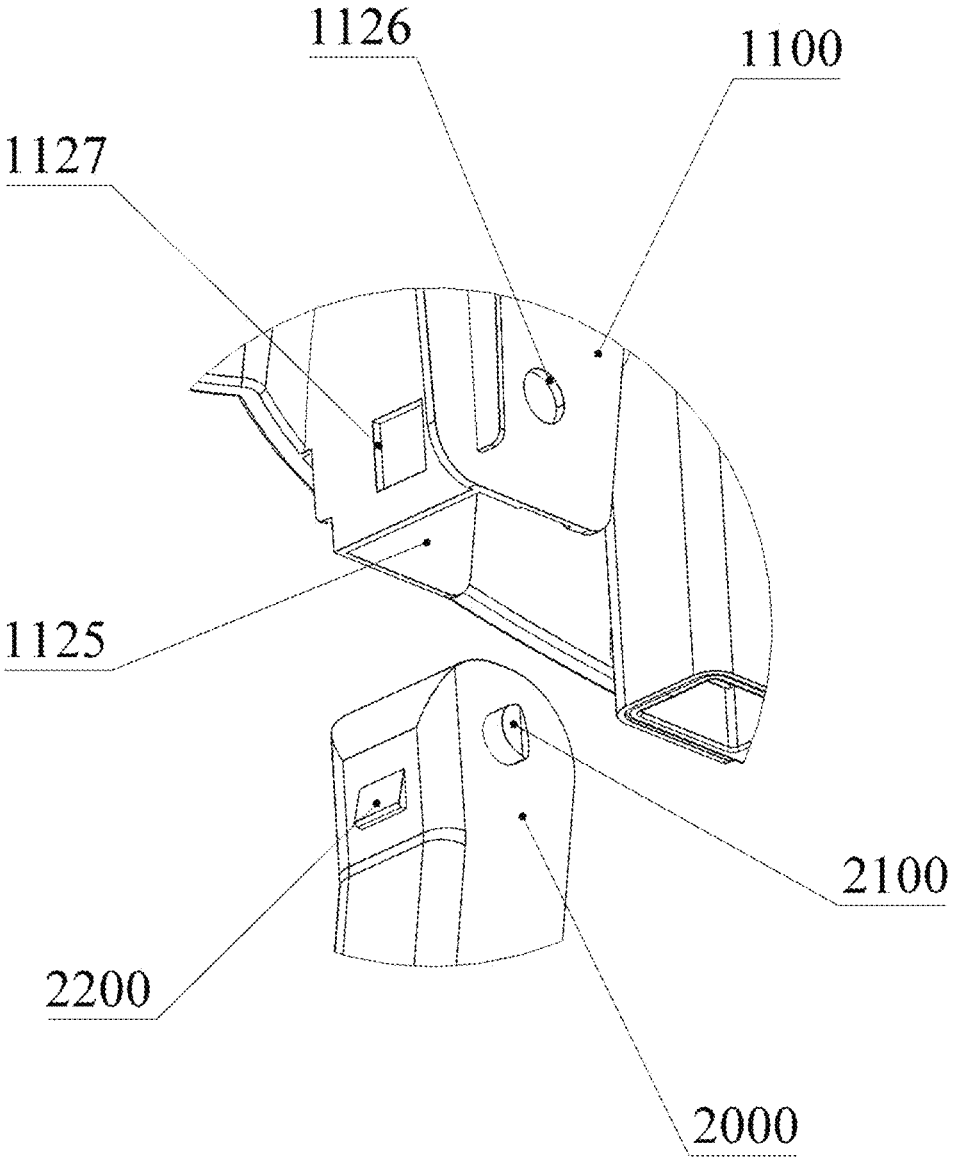
FIG. 11 is an enlarged schematic diagram of part C in FIG. 10.

As shown in FIGS. 10 to 11, in this embodiment, at least one mounting groove 1125 is provided on the first frame body 1100. A rotating shaft hole 1126 and a positioning hole 1127 are formed in the mounting groove 1125. A rotating shaft part 2100 and a positioning part 2200 are provided on the foot stand 2000. The foot stand 2000 is at least partially arranged in the mounting groove 1125, and the rotating shaft part 2100 is arranged in the rotating shaft hole 1126, and the positioning part 2200 is configured in the positioning hole 1127. The first frame body 1100 and the foot stand 2000 form a rotational connection through the rotating shaft hole 1126, the positioning hole 1127, the rotating shaft part 2100, and the positioning part 2200.

In this embodiment, the foot stand is set as a roughly "U"-shaped bracket. In other embodiments (not shown), the foot stand is not limited to being set in a "U" shape. It can also be set in a square, triangle, semi-circle, or any other desirable geometric shapes.

Specifically, at least one mounting groove is carefully provided on the first frame body. A rotating shaft hole and a positioning hole are formed inside each mounting groove. The positions and sizes of these two holes are precisely calculated and designed to ensure perfect cooperation with the corresponding components on the foot stand.

As an important part of the bath frame, the foot stand is provided with a rotating shaft part and a positioning part. The shapes, sizes, and materials of these components are strictly selected and tested to ensure that they can work stably in the mounting groove. When the foot stand is installed on the first frame body, at least part of it will be configured in the mounting groove. At this time, the rotating shaft part on the foot stand will be precisely arranged in the rotating shaft hole of the mounting groove, and the positioning part will be arranged in the positioning hole.

Through this design, a rotational connection is formed between the first frame body and the foot stand. This connection method is not only firm and reliable, capable of withstanding large weights and impacts, but also allows the first frame body and the foot stand to rotate relative to each other within a certain range. This rotation function enables the bath frame to easily achieve folding and unfolding, thereby meeting different usage requirements.

As shown in FIG. 1, in this embodiment, a seat protrusion 1322 and multiple drainage holes 1323 are provided on the seat part 1320.

Specifically, seat protrusions and multiple drainage holes are provided on the seat part, which not only enhances the user experience but also improves the practicality and comfort of the foldable bath frame. The design of the seat protrusions on the seat part fully considers the principles of ergonomics. The seat protrusions can provide better support and fit for users, enabling them to feel more stable and comfortable support when sitting down. This design can not only reduce the discomfort during long-term use of the bath frame but also improve the user's bathing experience.

Secondly, the multiple drainage holes provided on the seat part reflect the practicality. The existence of the drainage holes enables the bath frame to drain water effectively during use, avoiding the risk of slipping caused by water accumulation, and also facilitates users to clean the bath frame after use. This design not only improves the safety of the bath frame but also reduces the user's maintenance burden.

In addition, the combined design of the seat protrusions and the drainage holes also enhances the overall aesthetics of the bath frame. The shape and lines of the seat protrusions are carefully designed to echo the layout of the drainage holes, creating a harmonious and unified visual effect.

Figure 12:
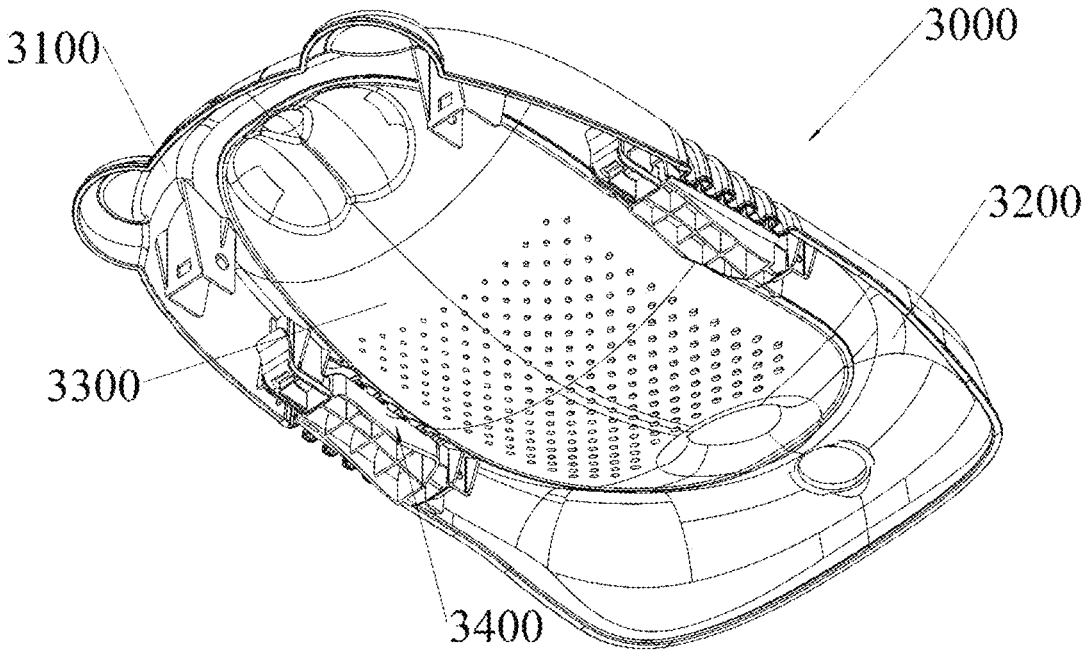
FIG. 12 is a schematic diagram of the second embodiment of the foldable bath frame.
Figure 13:
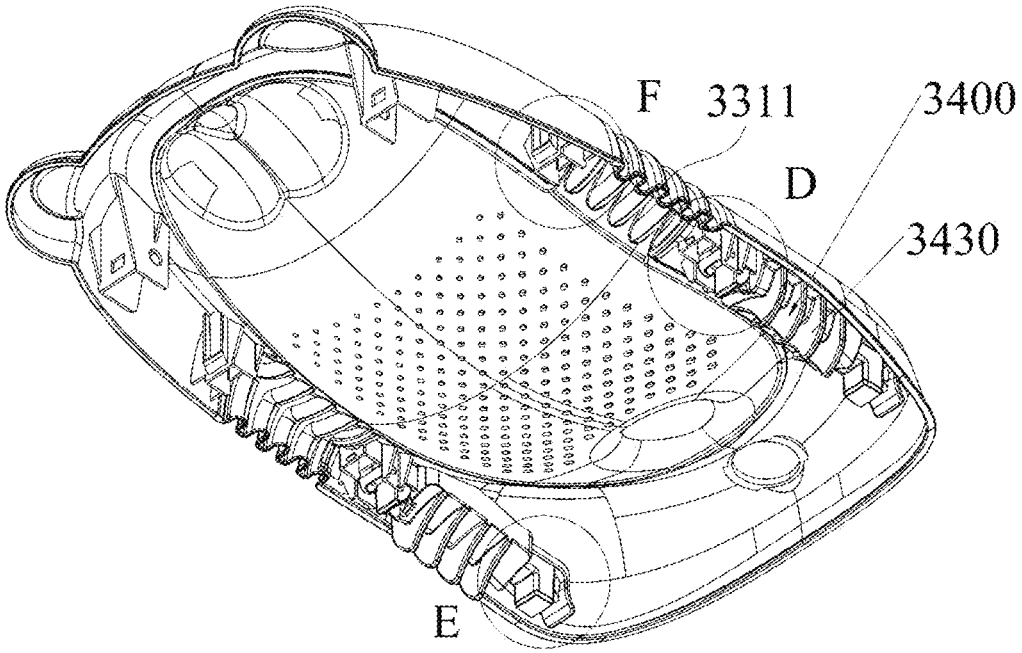
FIG. 13 is a schematic diagram after the fixing member in FIG. 12 is disassembled.

As shown in FIGS. 12 and 13, in the second embodiment of the foldable bath frame of the present disclosure, the foldable bath frame includes a bath frame body 3000 and a limiting assembly 3400. The bath frame body 3000 includes a first frame body 3100 and a second frame body 3200. The first frame body 3100 and the second frame body 3200 are connected to each other through a flexible connecting part. In this embodiment, the flexible connecting part is the seat part 3300, and the seat part 3300 is made of flexible materials. The flexible materials can be rubber, silicone, thermoplastic elastomer (TPE/TPU), etc., which have good elasticity and flexibility. The seat part 3300 will deform as the first frame body 3100 and the second frame body 3200 are unfolded or folded. The seat part 3300 made of flexible materials can not only adaptively deform during the unfolding and folding process of the bath frame, better fit the human body curve, and improve the comfort of use, but also enhance the user's experience when sitting on the bath frame and adapt to different state changes of the frame body.

As shown in FIGS. 12 and 13, the limiting assembly 3400 is arranged at the bottom of the first frame body 3100 and the second frame body 3200, and it has a first connecting end and a second connecting end opposite to each other. The first connecting end is detachably connected to the first frame body 3100 through a locking mechanism, and the second connecting end is rotatably connected to the second frame body 3200 through a rotating connection mechanism. The limiting assembly 3400 has a locked state and an unlocked state: when in the locked state, the first connecting end forms a rigid coupling with the first frame body 3100 through the locking mechanism. The limiting assembly 3400 provides rigid support for the first frame body 3100 and the second frame body 3200 and restricts the relative rotation and folding between the first frame body 3100 and the second frame body 3200. When in the unlocked state, the first connecting end is disengaged from the rigid coupling with the first frame body 3100 through the locking mechanism, releasing the rotation restriction on the first frame body 3100 and the second frame body 3200, so that the first frame body 3100 and the second frame body 3200 can rotate and fold relative to each other around the flexible connecting part. The limiting assembly 3400 realizes the conversion between the unfolded state and the folded state of the foldable bath frame through the detachable connection and the rotating connection. It is convenient for users to flexibly adjust the state of the bath frame according to the usage requirements and storage space. The bath frame can be folded and stored when not in use to save space.

Figure 15:
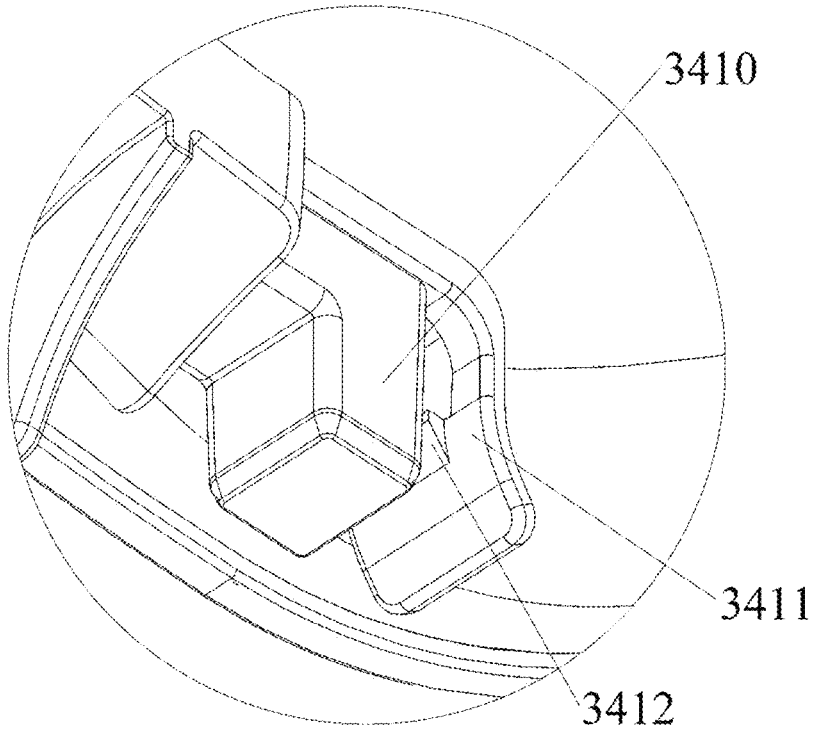
FIG. 15 is an enlarged schematic diagram of part E in FIG. 13.
Figure 16:
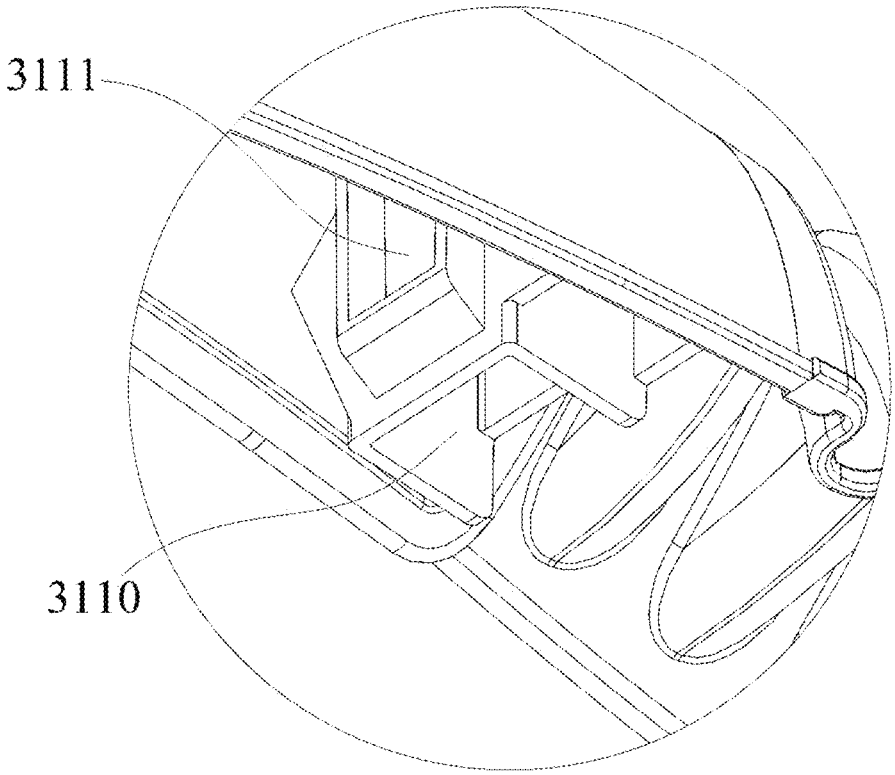
FIG. 16 is an enlarged schematic diagram of part F in FIG. 13.

As shown in FIGS. 13, 15 and 16, in this embodiment, the locking mechanism includes a first mounting cavity 3110 and a first mounting part 3410. The first mounting cavity 3110 is arranged at the bottom of the first frame body 3100, and a clamping groove 3111 is arranged on the outer side wall of the first mounting cavity 3110. The first mounting part 3410 is arranged at the first connecting end of the limiting assembly 3400, and an elastic sheet 3411 extends from the first mounting part 3410. A clamping protrusion 3412 is arranged on the elastic sheet 3411, and the clamping protrusion 3412 cooperates with the clamping groove 3111 to realize the detachable connection between the first mounting cavity 3110 and the first mounting part 3410. The cooperation between the clamping protrusion 3412 and the clamping groove 3111 realizes the detachable connection between the first connecting end of the limiting assembly 3400 and the first frame body 3100, which is convenient for users to quickly unfold and fold the bath frame. In other embodiments (not shown), the clamping groove 3111 is a through-hole opened on the side wall of the first mounting cavity 3110. The first mounting part 3410 is not provided with the elastic sheet 3411, and the clamping protrusion 3412 is arranged on the side wall of the first mounting part 3410. The cooperation between the clamping groove 3111 and the clamping protrusion 3412 realizes the detachable connection.

In other embodiments (not shown), in addition to the detachable connection method by using the above-mentioned clamping protrusion 3412 and clamping groove 3111, the first mounting cavity 3110 and the first mounting part 3410 can also be configured as other detachable connection structures. For example, magnetic connection, clamp connection, and buckle connection can be used. Magnetic connection can use the suction force of permanent magnets to achieve quick connection and separation, and has a certain automatic alignment function; clamp connection realizes connection through the fastening effect of the clamp and has high connection strength; buckle connection is simple to operate and convenient for users to operate quickly.

Figure 14:
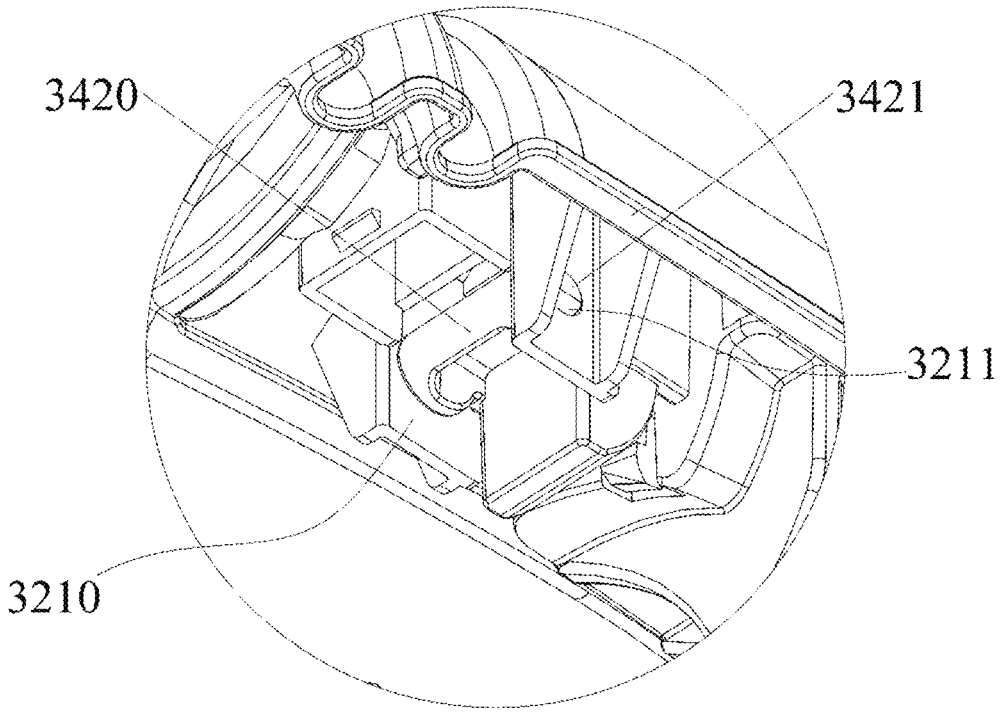
FIG. 14 is an enlarged schematic diagram of part D in FIG. 13.

As shown in FIG. 14, in this embodiment, the pivot connection mechanism includes a second mounting cavity 3210 and a second mounting part 3420. The second mounting cavity 3210 is set at the bottom of the second frame body 3200. The second mounting cavity 3210 is provided with a mounting hole 3211. The second mounting part 3420 is set at the second connecting end of the limiting assembly 3400. The second mounting part 3420 is provided with a mounting protrusion 3421. The mounting protrusion 3421 cooperates with the mounting hole 3211, so that the second mounting part 3420 can be rotatably installed on the second mounting cavity 3210. The inner diameter of the mounting hole 3211 should be slightly larger than the outer diameter of the mounting protrusion 3421 to ensure the flexibility of rotation. When the bath frame is in the folded state, the limiting assembly 3400 is placed at the bottom of the second frame body 3200 through the rotation of the first mounting part 3410. In other embodiments, the settings of the first mounting cavity 3110 and the second mounting cavity 3210 can be interchanged, that is, the first mounting cavity 3110 can be set at the bottom of the second frame body 3200, and the second mounting cavity 3210 can be set at the bottom of the first frame body 3100. The cooperation between the mounting protrusion 3421 and the mounting hole 3211 realizes the rotatable connection between the second connecting end of the limiting assembly 3400 and the second frame body 3200, ensuring stable connection and flexible rotation during the folding and unfolding processes.

In other embodiments (not shown), both ends of the limiting assembly 3400 adopt detachable connections. The second mounting cavity 3210 and the second mounting part 3420 are configured as the same detachable connection structure as the first mounting cavity 3110 and the first mounting part 3410. When both the first mounting part 3410 and the second mounting part 3420 are separated from the first mounting cavity 3110 and the second mounting cavity 3210, the limiting assembly 3400 is separated from the bath frame body 3000. When the bath frame body 3000 is folded, the limiting assembly 3400 can be placed at the bottom of the second frame body 3200, making storage more flexible and convenient.

As shown in FIG. 13, the seat part 3300 is provided with a corrugated part 3310. Multiple recesses 3311 are formed at the bottom of the corrugated part 3310. Multiple ribs 3430 that cooperate with the recesses 3311 are provided between the first connecting end and the second connecting end of the limiting assembly 3400. The shapes of the recesses 3311 and the ribs 3430 can be any shape, such as circular, square, or other polygons, as long as they can cooperate with each other to achieve the fixing function. When the second mounting part 3420 is installed in the second mounting cavity 3210, the first frame body 3100 and the second frame body 3200 are in the unfolded state. At this time, the ribs 3430 are inserted into the recesses 3311. The cooperation between the ribs 3430 and the recesses 3311 further fixes the seat part 3300 and the frame structure in the unfolded state of the bath frame, enhancing the overall stability. It prevents the seat part 3300 from shifting or shaking during use, improving the safety and stability of the bath frame.

In actual use, first, the second mounting part 3420 at the second connecting end of the limiting assembly 3400 is fitted with the mounting hole 3211 of the second mounting cavity 3210 at the bottom of the second frame body 3200 through the mounting protrusion 3421 to complete the rotatable connection; then, the first mounting part 3410 at the first connecting end of the limiting assembly 3400 is fitted with the clamping groove 3111 of the first mounting cavity 3110 at the bottom of the first frame body 3100 through the clamping protrusion 3412 to achieve the detachable connection. At this time, the ribs 3430 on the limiting assembly 3400 are inserted into the recesses 3311 at the bottom of the corrugated part 3310 of the seat part 3300, and the bath frame is in the unfolded and usable state. When it is necessary to fold the foldable bath frame, first the elastic sheet 3411 is toggled to disengage the clamping protrusion 3412 of the first mounting part 3410 from the clamping groove 3111 of the first mounting cavity 3110. At this time, the ribs 3430 on the limiting assembly 3400 are removed from the recesses 3311 at the bottom of the corrugated part 3310 of the seat part 3300, and the first connecting end of the limiting assembly 3400 is disconnected from the first frame body 3100. Then, the mounting protrusion 3421 of the second mounting part 3420 is rotated around the mounting hole 3211 of the second mounting cavity 3210 to make the whole limiting assembly 3400 fit the bottom of the second frame body 3200. Subsequently, the first frame body 3100 and the second frame body 3200 are folded inward, and the seat part 3300 shrinks with the deformation, thus completing the folding and storage.

The foldable bath frame provided by the present disclosure has many usage scenarios, including but not limited to the scenarios described below:

In the home bathroom environment, as a bathing auxiliary device, the bath frame provides users with a convenient, comfortable and safe bathing experience. The design of the seat protrusion enables family members, especially the elderly and children, to get better support during bathing, reducing the risk of accidents caused by slipping or instability. At the same time, the arrangement of multiple drainage holes ensures that the accumulated water during bathing can be drained in time, keeping the bath frame dry and clean, and further improving the comfort and safety of use.

In public bathing places, such as gyms and swimming pools, the bath frame is also widely used. Since public bathing places usually have a large flow of people, higher requirements are placed on the durability and safety of bathing equipment. The stable structure and innovative design of the above-mentioned bath frame enable it to adapt to high-frequency use while maintaining good performance. In addition, the design of the seat protrusion and drainage holes also takes public health issues into account, facilitating users to clean and disinfect the bath frame after use to ensure the health and safety of the next user.

In summary, the above-mentioned bath frame is suitable for various usage scenarios such as home bathroom environments and public bathing places. Its innovative design and excellent performance can meet the needs of different users and provide a comfortable and safe bathing experience.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A foldable bath frame, comprising:

a bath frame body (3000) with a foldable structure, wherein the bath frame body (3000) comprises a first frame body (3100) and a second frame body (3200) connected to each other through a flexible connecting part, and the flexible connecting part is configured to allow the first frame body (3100) and the second frame body (3200) to perform state conversion between an unfolded state and a folded state; and a limiting assembly (3400) that is arranged at a bottom of the bath frame body (3000) and has an operable first connecting end and a pivotally connected second connecting end;

wherein the second connecting end forms a pivotal connection with the second frame body (3200) through a pivot connection mechanism, and the first connecting end is configured with a locking mechanism that forms a releasable coupling with the first frame body (3100); and the limiting assembly (3400) has a locked state and an unlocked state:

when in the locked state, the first connecting end forms a rigid coupling with the first frame body (3100) through the locking mechanism, and the limiting assembly (3400) provides rigid support for the first frame body (3100) and the second frame body (3200), and restricts the relative rotational folding between the first frame body (3100) and the second frame body (3200); and when in the unlocked state, the first connecting end is disengaged from the rigid coupling with the first frame body (3100) through the locking mechanism, releasing the rotational restriction on the first frame body (3100) and the second frame body (3200), so that the first frame body (3100) and the second frame body (3200) are able to rotate and fold relative to each other around the flexible connecting part.

2. The foldable bath frame according to claim 1, wherein the locking mechanism comprises a first mounting cavity (3110) and a first mounting part (3410), wherein the first mounting cavity (3110) is arranged at a bottom of the first frame body (3100), and the first mounting part (3410) is arranged at the first connecting end of the limiting assembly (3400).

3. The foldable bath frame according to claim 2, wherein a clamping groove (3111) is arranged on an outer side wall of the first mounting cavity (3110), an elastic sheet (3411) extends from the first mounting part (3410), and a clamping protrusion (3412) is arranged on the elastic sheet (3411), wherein the clamping protrusion (3412) cooperates with the clamping groove (3111) to realize a releasable coupling between the first mounting cavity (3110) and the first mounting part (3410).

4. The foldable bath frame according to claim 2, wherein a through-hole type clamping groove (3111) is provided on a side wall of the first mounting cavity (3110), a clamping protrusion (3412) is provided on the side wall of the first mounting part (3410), and the clamping protrusion (3412) cooperates with the clamping groove (3111) to realize a releasable coupling between the first mounting cavity (3110) and the first mounting part (3410).

5. The foldable bath frame according to claim 1, wherein the pivot connection mechanism comprises a second mounting cavity (3210) and a second mounting part (3420), wherein the second mounting cavity (3210) is provided at a bottom of the second frame body (3200), and the second mounting part (3420) is provided at the second connecting end of the limiting assembly (3400).

6. The foldable bath frame according to claim 5, wherein a mounting hole (3211) is provided on the second mounting cavity (3210), and the second mounting part (3420) is provided with a mounting protrusion (3421), wherein the mounting protrusion (3421) cooperates with the mounting hole (3211) to pivotally connect the second mounting part (3420) to the second mounting cavity (3210).

7. The foldable bath frame according to claim 6, wherein when the first frame body (3100) and the second frame body (3200) are folded, the limiting assembly (3400) is placed at the bottom of the second frame body (3200) through the rotation of the second mounting part (3420).

8. The foldable bath frame according to claim 1, wherein the releasable coupling is one of a clamping connection, a magnetic connection, a hoop connection, or a buckle connection.

9. The foldable bath frame according to claim 1, wherein the flexible connecting part is a seat part (3300), which is provided with a corrugated part (3310), and the corrugated part (3310) is able to adaptively deform during unfolding and folding processes of the first frame body (3100) and the second frame body (3200).

10. The foldable bath frame according to claim 9, wherein a plurality of recesses (3311) are formed at a bottom of the corrugated part (3310), a rib (3430) that cooperates with the recess (3311) is provided between the first connecting end and the second connecting end of the limiting assembly (3400), and when the bath frame is in the unfolded state, the rib (3430) is inserted into the recess (3311).

11. The foldable bath frame according to claim 9, wherein the seat part (3300) is provided with a seat protrusion (1322), and the seat protrusion (1322) is designed with ergonomics to provide a stable support.

12. The foldable bath frame according to claim 9, wherein the seat part (3300) is provided with a plurality of drainage holes (1323), and the drainage holes (1323) are used for effective drainage of the bath frame during use.

13. The foldable bath frame according to claim 1, wherein the bottom of the first frame body (3100) is rotatably connected with a foot stand (2000).

14. The foldable bath frame according to claim 13, wherein the bottom of the first frame body (3100) is provided with a mounting groove, in which a rotating shaft hole (1126) and a positioning hole (1127) are formed, and the foot stand (2000) is provided with a rotating shaft part (2100) and a positioning part (2200), wherein the foot stand (2000) is at least partially disposed in the mounting groove, the rotating shaft part (2100) is disposed in the rotating shaft hole (1126), and the positioning part (2200) is disposed in the positioning hole (1127); and wherein, the first frame body (3100) and the foot stand (2000) are rotatably connected through the rotating shaft hole and the rotating shaft part (2100), and the positioning hole and the positioning part (2200) are configured to form a lock when the foot stand (2000) rotates to a predetermined position.

* * * * *